US005778713A

United States Patent [19]

Butler et al.

[11] Patent Number: 5,778,713

[45] Date of Patent: Jul. 14, 1998

[54] METHOD AND APPARATUS FOR ULTRA HIGH PRESSURE WATER JET PEENING

[75] Inventors: Tom Butler, Enumclaw; Dave Monserud, Seattle; Dave Bothell, Kent; Dave Steele; John Hake, both of Seattle, all of Wash.

[73] Assignee: Waterjet Technology, Inc., Kent, Wash.

[21] Appl. No.: 855,288

[22] Filed: May 13, 1997

[51] Int. Cl.[6] ..... B24C 1/00; B24C 3/00

[52] U.S. Cl. ..... 72/53; 451/39; 451/40

[58] Field of Search ..... 72/53; 451/39, 451/40

[56] References Cited

U.S. PATENT DOCUMENTS

| | | | |
|---|---|---|---|
| 4,038,786 | 8/1977 | Fong | 451/39 |
| 4,703,590 | 11/1987 | Westergaard | 451/320 |
| 4,707,951 | 11/1987 | Gibot et al. | 451/39 |
| 4,869,090 | 9/1989 | Tada et al. | 72/53 |
| 4,932,168 | 6/1990 | Tada et al. | 451/39 |
| 5,147,466 | 9/1992 | Ohmori et al. | 451/39 |
| 5,305,361 | 4/1994 | Enomoto et al. | 376/316 |
| 5,599,223 | 2/1997 | Mains, Jr. | 451/39 |

FOREIGN PATENT DOCUMENTS

| | | | |
|---|---|---|---|
| 2111445 | 9/1972 | Germany | 72/53 |
| 2190263 | 7/1990 | Japan | 72/53 |

OTHER PUBLICATIONS

Kazunori Sato, A Study on Peening by Submerged Ultra High Speed Water Jets, 11th International Conference on Jet Cutting Technology, Sep. 8–10 1995 Held in St. Andrews, Scotland United Kingdom.

*Primary Examiner*—David Jones
*Attorney, Agent, or Firm*—Don R Mollick

[57] ABSTRACT

The invention describes a method and apparatus for peening objects by means of ultrahigh velocity waterjet. The apparatus includes means for holding and producing relative motion in three dimensions of both the workpiece and the jet. Control means are provided to allow uniform and variable depth peening of complex shapes and automatic variations in relative speed, standoff distance, angle and pressure. The method includes the use of entrained disappearing particles in the waterjet to facilitate peening.

18 Claims, 4 Drawing Sheets

METHOD AND APPARATUS FOR ULTRA HIGH PRESSURE WATER JET PEENING

FIELD OF INVENTION

This invention pertains to the treatment of materials. In particular this invention pertains to the peening of the surface of materials for altering the properties of the material by localized compression and consequent alteration of crystal structure. The method further includes the use of disappearing particles entrained in the jet and an apparatus for accomplishing the method.

BACKGROUND OF INVENTION

Materials have been peened by many methods in the past. Peening is defined as the process of altering the surface of a material by impact. The peening processes were originally developed after blacksmiths notice that metal was hardened by repeated hammer blows particularly if such blows were delivered while the metal was cold. If the metal was hot or beaten to heat the desirable characteristics were often lost. The process is sometimes called "cold working" for this reason. The effect is somewhat similar to the phenomena known as "work hardening". The use of peening results in a material which is more resistant to corrosion and fatigue.

The peening process is typically accomplished today with the use of air-or centrifugal propelled shot aimed to impact the surface of the material sought to be peened. The shot may be either metal shot or ceramic balls. The impact of the shot compresses the surface of the part beyond its yield strength causing the deeper unyielded material to hold the surface material in compression. It is this surface residual compressive stress that provides the fatigue and corrosion resistance. Today peening is commonly used on such diverse metals as iron alloys, titanium, honeycomb skins and ISO grid panels in addition to the traditional materials. Shot peening also is used to shape and work harden surfaces in these materials. Peening is use extensively in the nuclear and aircraft industries Several problems have arisen with conventional shot peening methods. The difficulties include contamination, process control, and waste disposal of used shot. Many materials can be contaminated by the shot particularly if it is metallic. Small shot may plug up passages if used in areas such as aircraft engine parts. Shot contamination can change the properties of the workpiece including formation of unwanted alloys and corrosion nuclei. Process control is difficult when dealing with essentially ballistic propelled shot. In addition, small radii cannot be reached by larger shot sizes resulting in inadequate treatment of fillets and the like. Reducing the shot size is not always a satisfactory solution as smaller shot may not deliver sufficient energy to adequately cold work the material or obtain a desirable depth of compression exceed the yield strength of the material sought to be peened. Finally, it is often difficult to retrieve used shot particularly if it is ceramic (eliminating the possibility of magnetic separation.). This problem is particularly critical in the case of in situ peening of nuclear reactor components. In that case waste shot may clog critical cooling or control passages. The fuel bundle could also be damaged due to damage to cladding. Air can also cause contamination by making metal particles airborne.

The above problems with shot peening have led to the proposal of the use of liquid jets for peening. An example of such a proposal is found in U.S. Pat. No. 5,305,361 to Enomoto. Enomoto describes a process for peening nuclear reactor components with vibrating nozzle water-jets. In Enomoto it was deemed to be essential to vibrate the nozzle in order to induce (cavities in the jet stream. The collapse of the cavities induced increases the force delivered to the material sought to be peened. Enomoto teaches that the use of non-vibrated jet streams are not viable due to the super high pressures required to deform the surface of the material. Emomoto appears to be limited to the special case of peeing the underwater interior surfaces of nuclear reactors. Due to the low pressures and high flow rates in Emomoto the apparatus must be of substantial size and expense to withstand the reactive force as a result of flow rate and pressure requiring removal of the fuel bundle before peening.

BRIEF DESCRIPTION OF THE INVENTION

The invention provides a method and apparatus for peening of materials by use of ultra high pressure waterjet. The discoveries herein recounted are adaptable to a wide variety of materials ranging from the titanium to aluminum honeycomb. The invention provides methods to control the peening force to a much greater degree than prior methods. The apparatus allows the peening of shapes that could not be peened by conventional shot peening methods. The method prevents contamination of peened surfaces. No shot need be disposed of as no shot is used. The method may be accomplished with relatively inexpensive small apparatus. There is no shot to plug small cavities.

The method involves the use of at least a single ultra high pressure waterjet nozzle. The ultra high pressure fluid exits the nozzle and impacts the metal surface a short distance away. Ultra high pressure is necessary for the jet velocity to be high enough to cause yielding of the metal surfaces either directly or by accelerating particles in the fluid (such as ice) or by cavitaion bubble collapse. The jet is moved relative to the workpiece. This movement can be accomplished by either moving the workpiece in two or three dimensions relative to the jet or by moving the jet itself. One or two of the three directions may be rotational under this method. The method also contemplates varying the speed of such relative movement as well as angle and force. Control of each of the above factors must be maintained to compensate for variation in any of the other factors.

The apparatus of the invention includes an ultra high pressure water jet. The jet is provided with an appropriate supply of fluids and particles if used. The jet is attached to a manipulator which allows the direction of the jet to be moved in three dimensions. These dimensions may be the traditional Cartesian coordinates in some applications. Other applications may demand that the jet be movable over a plane but have unrestricted rotational freedom. Finally the jet may be movable along a line segment and have two degrees of rotational freedom for yet a third class of applications. In any of the above three classes of apparatus movement of the workpiece can be substituted for movement of the jet. In addition, the apparatus provides for varying the peening power of the jet during the peening operation. In addition to variation of position and strength of the jet the speed of relative motion is capable of continuous variation. The apparatus provides simultaneous control of all of these functions to provide accurate cold working of material.

In summary, the method and apparatus allow the peening of a wide variety of materials into shapes not easily created by conventional peening methods. The method and apparatus also allow peening in a number of environments where conventional shot peening is impossible.

DETAILED DESCRIPTION OF THE FIGURES

In all embodiments of the invention it has been found that that there are several previously unrecognized factors which enter into the process. The first of these is the existence of an incubation period. Studies of cavitation have revealed the existence of an incubation period. The incubation period is the period of time during which the material is subjected to cavition bubble collapse but does not experience any material loss. Ultrahigh pressure water jet peening operates during this period of time to cold work the workpiece without causing material loss.

The second factor is the determination and effect of stand off on peening. Standoff is the distance from the nozzle to the work piece. Standoff determines the intensity and mechanism of peening. In waterjet cutting it is desirable to place the nozzle as close as possible to the workpiece. In ultrahigh pressure waterjet peening in contrast there must be sufficient distance between the nozzle and workpiece for cavitation bubbles to form and collapse on the workpiece. If the peening is accomplished solely by impact pressure the standoff must be short. The optimum standoff thus varies according to operating conditions.

The final factor is the temperature effect. If the fluid temperature is close to the boiling point there is an increased tendency to cavitate. The invention in all embodiments heats the fluid and substantially increases cavitation and peening effect.

Figure 1:
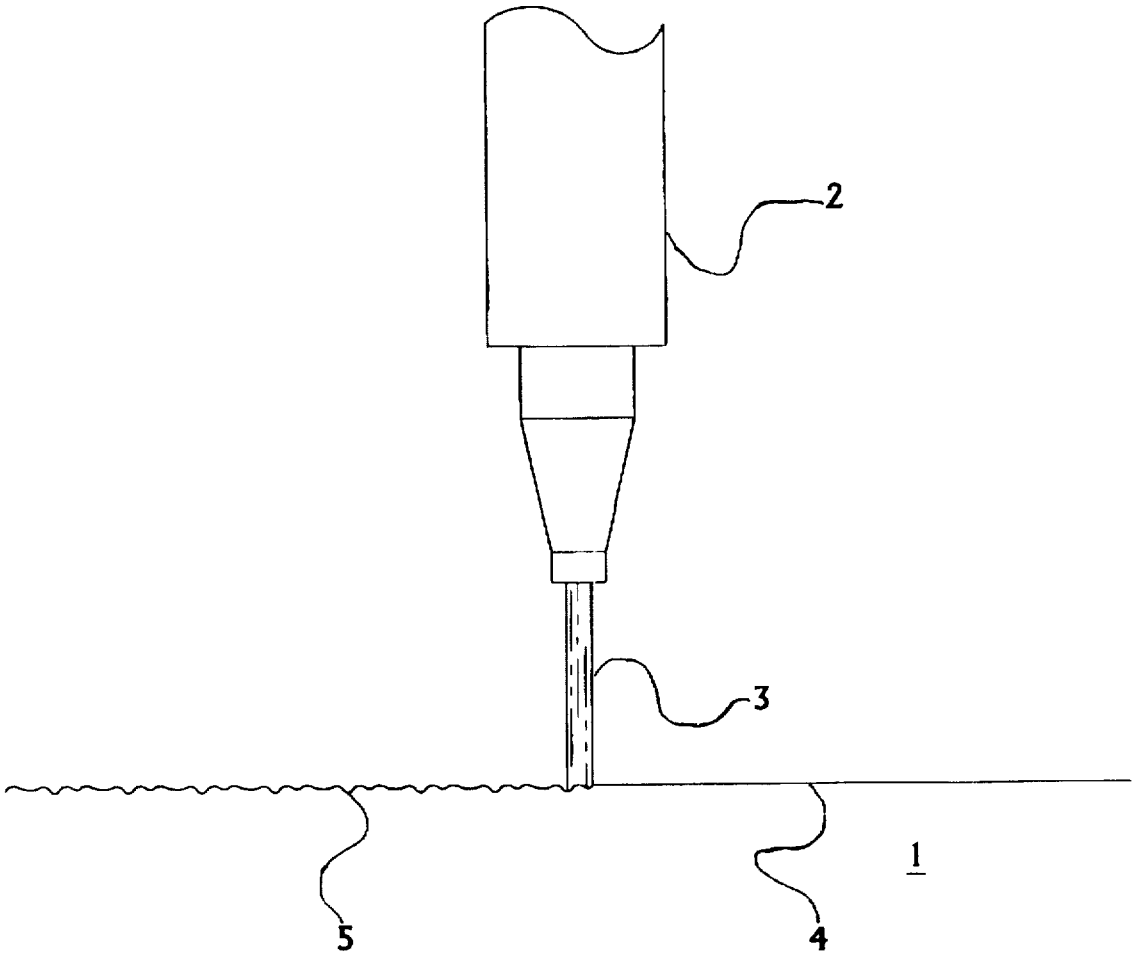
FIG. 1 is a front elevation of the method of the invention

FIG. 1 is a front elevation view of the method of the invention. This apparatus accomplishing the method in its most basic form is illustrated.

The unpeened surface of workpiece 1 is located near a ultra high pressure nozzle assembly 2. Nozzle assembly 2 is provided with a flow of ultra high pressure fluid. For purposes of this invention ultra high pressures are defined as pressures over 20,000 p.s.i and preferably over 50,000 p.s.i. A suitable nozzle assembly is illustrated in U.S. Pat. No. 5,320,289. An ultra high pressure waterjet 3 issues from Nozzle 2 when ultrahigh pressure fluid is applied to nozzle 2. Nozzle 2 is moved across the surface of workpiece 1. When jet 3 impacts workpiece the surface 5 of workpiece yields to the impact pressure of jet 3, resulting in peened surface 5. The thrust load on nozzle 2 is proportional to the flow rate times the square root of the pressure. For example a pressure of 60,000 at a flow rate of 2.5 gallons per minute would yield a relative thrust of 1. The energy available for plastic deformation of surface 1 is approximately the cube of the pressure. This means four times the pressure increases the peening intensity by 64. An eighty eight horsepower pump is required to produce this pressure and flow a larger pump increases effectiveness.

Figure 3:
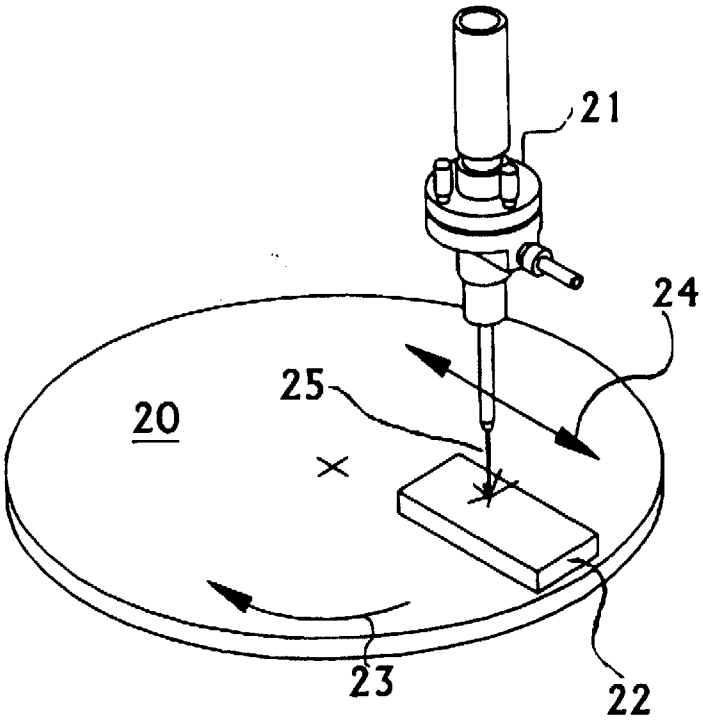
FIG. 3 is a perspective detail view of a third embodiment of the apparatus of the invention.
Figure 2:
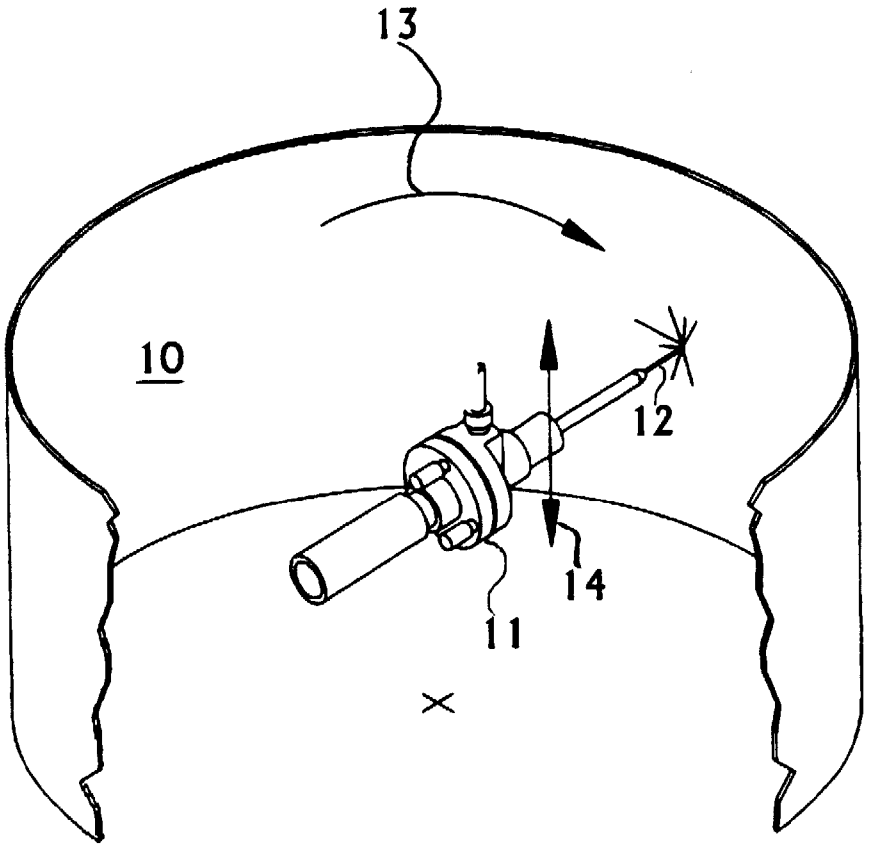
FIG. 2 is a perspective detail view of a second embodiment of the apparatus of the invention.

In contrast, the relative thrust of a vibrating pressure jet having a pressure of 15,000 p.s.i would produce a relative thrust of 4 with a flow of 20 gallons per minute. This nozzle would require a 176 horse power pump to produce 1/64 the peening power. In order to produce a comparable peening intensity to the ultrahigh pressure nozzle a high pressure vibrating nozzle would require a prohibitively large pump and support structure to absorb the reactive force. FIG. 2 is a perspective detail view of a second embodiment of the apparatus of the invention. The FIG. 2 embodiment is adapted to peen the inside of a cylindrical workpiece 10. A waterjet nozzle 11 is situated within workpiece 10. Workpiece 10 is adapted for rotation 13 relative to nozzle 11. Rotation 13 may be accomplished by rotating work piece 10 or by rotating nozzle 11. A waterjet 12 emerges from nozzle 11 in close proximity to workpiece 10. Nozzle 14 is adapted to move in a vertical direction 14 parallel to the length of workpiece 10. In operation Workpiece 10 is rotated along 13 and nozzle moved vertically 14 in such a manner that a spiral path is followed by jet 12 along the entire interior surface of work piece 10. The peening operation is performed in the same manner as described in the detailed explanation of FIG. 1. FIG. 3 is a perspective detail view of a third embodiment of the apparatus of the invention. In the third embodiment the workpiece 22 is attached to a rotatable platter 20 which allows movement of platter 20 and workpiece 22 in the direction of arrow 23. A waterjet nozzle 21 is located above and in proximity to workpiece 22. A waterjet 25 emerges from nozzle 21 and impacts workpiece 22. Nozzle 21 is movable in a radial direction 24. In operation Workpiece 22 is rotated along 23 and nozzle moved radial 24 in such a manner that a spiral path is followed by jet 25 along the entire upper surface of work piece 22. The peening operation is performed in the same manner as described in the detailed explanation of FIG. 1.

Figure 4:
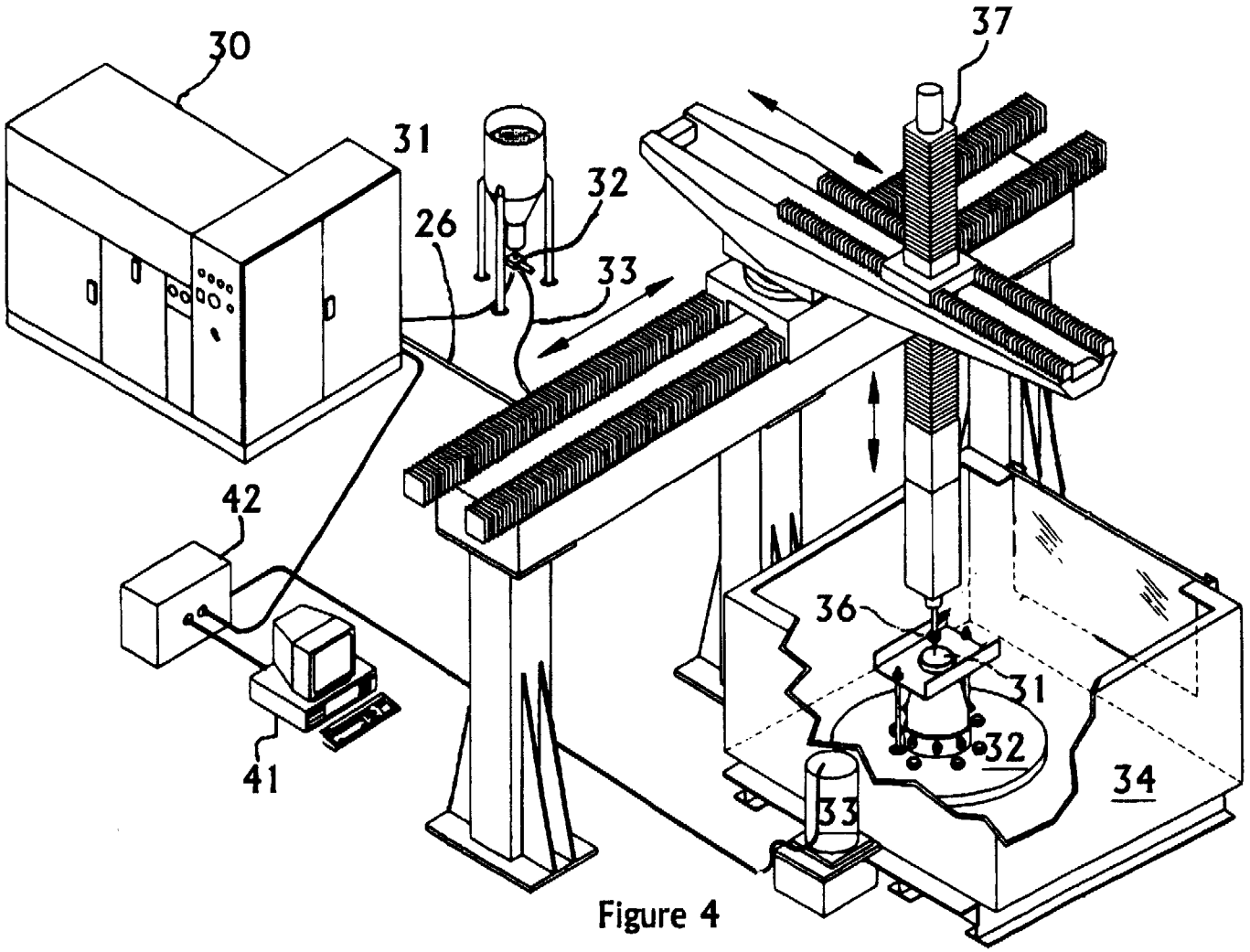
FIG. 4 is a perspective view of the FIG. 3 embodiment.

FIG. 4 is a perspective view of the apparatus of the third embodiment of the invention. This apparatus is particularly adapted to the peening of surfaces on materials having a single axis of symmetry able to be rotated. Examples include disks, cylinders, cones and spheres. The apparatus illustrated is a prototype peening center. The components and parameters used are similar to commercial systems, this apparatus introduces several additional means to control peening not present in the FIG. 1–3 apparatus.

The workpiece 31 is attached to a platter 32. In this illustration workpiece 21 is a disk. Platter 32 is adapted for rotation by a motor 33. A waterjet 36 is located above the workpiece 31. Waterjet 36 is movable in the x or horizontal direction by traverse system 37. Waterjet 36 is also movable in the vertical direction or y by a traverse system 37. Waterjet 36 is also movable in the horizontal direction or z by a traverse system 37. Traverse system 37 also called a x-y-z manipulator is a commercially available system which allows movement in all three Cartesian coordinates. In the apparatus shown waterjet is, therefore, movable in all directions along all Cartesian coordinates. Workpiece 31 is movable along the axis of rotation of platter 32. The illustrated apparatus is thus roughly analogous to a milling machine with the further capability of cold working irregular surfaces in three dimensions. Waterjet 36 is supplied with high pressure liquid through supply line 26 from an ultra high pressure liquid pump 30. Particles such as ice or dry ice if used may be supplied from hopper 31 via metering/shutoff valve 32 and supply line 33. Components 31,33,34 and 36 are optionally contained in a water collection tank 34 which serves to contain liquid to prevent contamination of the work area. The operation of all components is controlled by a computer 41 interfacing through a system controller 42.

To operate the apparatus of FIG. 4 a workpiece 31 is first attached to platter 32. In this embodiment a disk is being peened. Motor 33 is started and rotation of platter 32 and workpiece 31 begun. High pressure fluid is then supplied to waterjet 36 via supply fine 39 along with particles from hopper 31. Traverse system 37 sweeps water jet 36 across the upper face of workpiece 31. In operation waterjet 36 peens workpiece 31. The process continues until workpiece 31 is peened to the desired depth over its entire surface. When the desired degree of peening is attained the pressure supplied to waterjet 36 is decreased.

Figure 5:
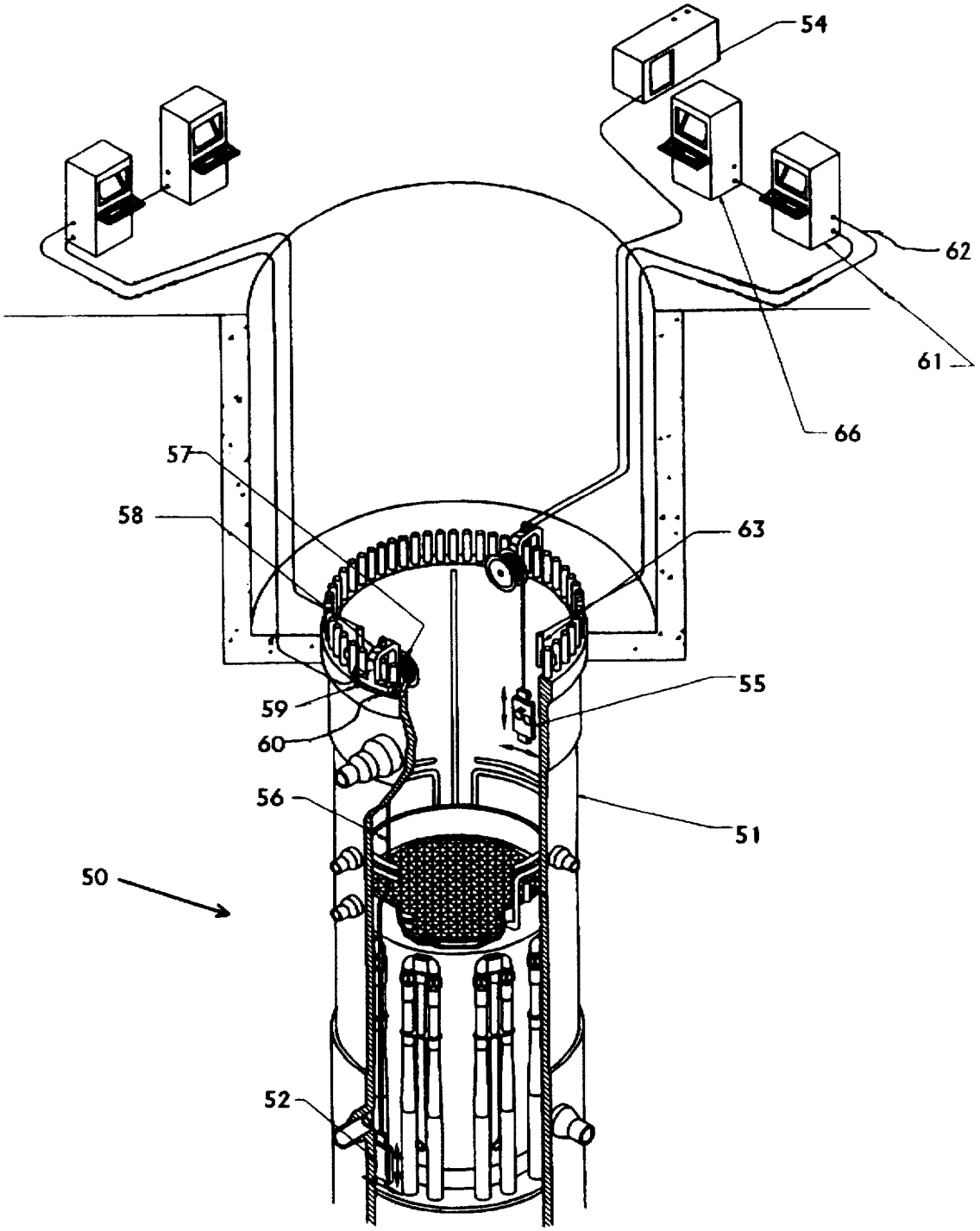
FIG. 5 is a front elevation section view of a fourth embodiment of the invention in a nuclear reactor.

Control of the sweep rate provides a second manner to alter the peening of the finished product. In this manner the area at the center or any other portion of a pocket can be peened to a greater depth than an edge. Alternatively, the stand off distance of abrasive jet 36 can be varied by manipulator 38 to control the rate of peening. This method can either be used to provide even peening, or compensate for alterations in tangential velocity due to workpiece 1's shape as described above. The angle of waterjet 36 to workpiece 31 can further control the speed of peening. After the peening process is completed it is desirable to shut valve 32 and remove workpiece 31. The apparatus of FIG. 4 is equally adapted to peen cylindrical, conical, or even irregularly shaped objects by programming the shape of the workpiece into computer FIG. 5 is a front elevation section view of a fourth embodiment of the invention in a nuclear reactor. As noted above nuclear reactors are a particularly difficult environment for peening operations, in addition to corrosion induced cracking and fatigue induced cracking the is the possibility of irradiation induced corrosion cracking. This has led to the proposed use of in situ peening of reactor components. In this environment the loss and disposal of shot has become a particular problem. That problem has prevented use of in situ peening to date. The process illustrated herein is applicable to boiling water, pressurized water reactors and any water moderated reactor. The invention is illustrated herein on a boiling water reactor two identical crawlers 52 and 55 are shown for clarity.

Reactor 50 is a typical boiling water reactor having a shroud 51. Shroud 51 is typically made out of austenitic stainless steel which is prone to developing intergranular stress corrosion cracking in the welded areas. Obviously cracking in shroud 51 is undesirable. Peening has been found to be a satisfactory method for preventing such cracking in other applications. Unfortunately shot peening is unsatisfactory due to the disposal problems and the above problems with small radius fillets. A crawler vehicle 52 is perfectly adapted for peening use. Crawler vehicle 52 is provided with an ultrahigh pressure water jet as described in FIG. 1. Returning to FIG. 5 crawler vehicle 52 is provided with ultrahigh pressure from a ultra high pressure pump 54 via supply line 56. Supply line 56 is drawn in and out of a support reel 57 to allow movement in the vertical direction. Support reel 57 is held on a support reel carriage 58 which is movable along the circumference of shroud 52. Movement of carriage 58 around shroud 51 is provided by drive sprockets 59 and 60. A controller 61 transmits information controlling sprockets 59 and 60 and reel 57 through wire 62. A self aligning vertical laser 63 mounted to RPV studs is also attached to controller 61 and a data acquisition unit 66 via wire 64 provides information on the position of vehicle 52 and allows feedback control of vehicle 52. Crawler 52 measures the degree of peening and feeds the data back to unit 66. The information is used to control the peening operation.

In operation crawler 52 is lowered by reel 57 in a vertical fine while the ultra high pressure water jet is operated to produce a vertical peened line. Carriage 58 is then advance the width of the peened line and the operation repeated. The peening operation is performed in the same manner until the entire inner surface of shroud 51 is peened. The operation is done while the shroud is filled with water.

It has been found that in water the water jet is more effective the deeper the nozzle is operated up to a depth of approximately 45 feet. This is believed to be due to a intensified effect of bubble collapse. This effect diminishes with increasing depth as the formation of cavitation bubbles is suppressed becoming equal to that in air at near 90 foot depth.

The above examples and embodiments are exemplary only the invention being defined solely by the attached claims.

We claim:

1. A method for peening a metal including the steps of producing a volume of ultra high pressure fluid; wherein the pressure of said volume of fluid is over 20,000 p.s.i and; conveying said high pressure waterjet cutting nozzle; and ; releasing said ultra high pressure fluid to form an ultra high pressure waterjet, moving said ultra high pressure waterjet across the surface of metal sought to be peened in such a matter that said ultra high pressure waterjet contacts and compresses the surface of said metal until substantially all of the surface sought to be peened has been contacted by said jet and has been compressed, ceasing operation of said jet.

2. A method for peening a metal as in claim 1, wherein the pressure of said volume of fluid is over 50,000 p.s.i.

3. A method for peening a metal as in claim 1, wherein moment of the waterjet describes a spiral.

4. A method for peening a metal as in claim 1, wherein said nozzle and the workpiece are submerged in a liquid for increasing cavitation to increase peening.

5. A method for peening a metal as in claim 1, wherein the distance between said nozzle and said workpiece is selected to be sufficient to cold work the workpiece without removing substantial material from the workpiece.

6. A method for peening a metal as in claim 1, further comprising the step of adding solid particles to the waterjet to increase the effectiveness of peening.

7. A method for peening a metal as in claim 6, wherein said solid particles disappear after the peening operation is completed.

8. A method for peening a metal as in claim 7, wherein said solid particles are ice.

9. A method for peening a metal as in claim 1, wherein said movement moves said waterjet in a line, then moves the waterjet along an adjacent line until the entire surface of the metal sought to be peened has been peened.

10. A peening machine comprising: pump means for producing a volume of ultra high pressure fluid; wherein the pressure of said volume of fluid is over 20,000 p.s.i and; conduit means connected to said pump means for conveying said high pressure fluid; and nozzle means connected to said conduit means for forming an ultra high pressure waterjet; and, transform means for moving said ultra high pressure waterjet across the surface of metal sought to be peened in such a matter that said ultra high pressure waterjet contacts and compresses the surface of said metal until substantially all of the surface sought to be peened has been contacted by said jet and has been compressed without material loss.

11. A peening machine as in claim 10, wherein the pressure of said volume of fluid is over 50,000 p.s.i.

12. A peening machine as in claim 10, wherein said transform means moves said waterjet in a spiral.

13. A peening machine as in claim 10, further comprising immersion means for submerging said nozzle and the metal in a liquid for increasing cavitation to increase peening.

14. A peening machine as in claim 10, further comprising stand off control means for adjusting the distance between said nozzle and said workpiece to be sufficient to cold work the workpiece without removing material from the workpiece.

15. A peening machine as in claim 10, further comprising particle injection means for adding solid particles to the waterjet to increase the effectiveness of peening.

16. A peening machine as in claim 15, wherein said particle injection means is adapted to inject particles solid particles disappear after the peening operation is completed.

17. A peening machine as in claim 16, wherein said particle injection means is adapted to inject particles solid particles are ice.

18. A peening machine as in claim 10, wherein said transform means is adapted to move said waterjet in a line and is further adapted to move the waterjet along an adjacent line until the entire surface of the metal sought to be peened has been peened.

* * * * *